United States Patent [19]

Aspenwall

[11] Patent Number: 4,994,943

[45] Date of Patent: Feb. 19, 1991

[54] CANTILEVERED LIGHTING SYSTEM

[76] Inventor: John E. Aspenwall, 301 Draper La., Provo, Utah 84603

[21] Appl. No.: 522,744

[22] Filed: May 14, 1990

[51] Int. Cl.[5] ..... F21S 3/00

[52] U.S. Cl. ..... 362/219; 362/217; 362/220; 362/247; 362/432

[58] Field of Search ..... 362/217, 219, 220, 427, 362/432

[56] References Cited

U.S. PATENT DOCUMENTS 4,598,344 7/1986 Nadler ..... 362/220

4,803,606 2/1989 Rotter ..... 362/220

*Primary Examiner*—Carroll B. Dority

*Attorney, Agent, or Firm*—M. Reid Russell

[57] ABSTRACT

A cantilevered lighting system having conventional slotted wall mounted support posts and cantilevered arms fixed into the slots of the support posts and projecting from which support posts to adjustably secure support rods that are attached to the cantilevered arms with a pair of top clips and a bottom adjustable wedge clip; a pivotally adjustable cradle is arranged on the end of each support rod and a tubular light housing having an opening in the wall thereof at one side and with edges of that opening to snap onto notched support arms of the pivotally adjustable cradle. The light housing for mounting at least one elongate lamp.

4 Claims, 2 Drawing Sheets

CANTILEVERED LIGHTING SYSTEM

BACKGROUND OF THE INVENTION

1. Field of the Invention

This invention relates to lighting systems and particularly to systems that can be mounted to provide either direct or indirect light and be either permanently, semi-permanently or temporarily mounted.

2. Prior Art

Many kinds of direct and indirect lighting systems for buildings have been proposed in the past. These include light fixtures and mountings to secure the fixtures to joists, trusses and other building structural components and within structures such as a display or show case and generally the mountings are intended to permanently secure the fixtures in place. So called "Track Lighting" systems, for example employ permanently mounted ceiling and wall tracks with electrical contact strips and light fixtures to clamp into the tracks and to make electrical contact with the electrical contact strips.

Some lighting systems have been developed to accommodate variable positioning of light fixtures as, for example, within a display or show case. A pending patent application of the present invention, entitled "Lighting System for Display Cabinet", Ser. No. 511,401, filed April 19, 1990, and the earlier patents cited therein, show systems for mounting fluorescent lamps within display cases, which mountings, however, are not cantilevered.

There remains a need for a lighting system that can be quickly, inexpensively and easily installed or removed; that is sturdy and that will provide selected direct or indirect light to the room or within a structure in which it is installed.

OBJECTS OF THE INVENTION

Principal objects of the present invention are to provide a lighting system that can be adapted to use in any desired room or within a structure wherein standard slotted shelf supports and cantilevered support brackets can be mounted.

Other objects are to provide a lighting assembly that can be installed with a minimum number of tools and that can be adjusted to provide direct or indirect lighting and to vary the position of the light tubes used toward or away from a supporting wall or side.

FEATURES OF THE INVENTION

Principal features of the invention in a cantilevered tubular light housing support include support rods that are attached to conventional shelf support brackets by upper clips and adjustable lower wedge clips, which support rods include cradle supports that are pivotally mounted onto the ends of the rods and are to be snapped into an opening of the tubular light housing.

Other objects and features of the invention will become apparent from the following detailed description and drawing disclosing what are presently contemplated as being the best modes of the invention.

THE DRAWINGS

DETAILED DESCRIPTION OF THE INVENTION

Figure 2:
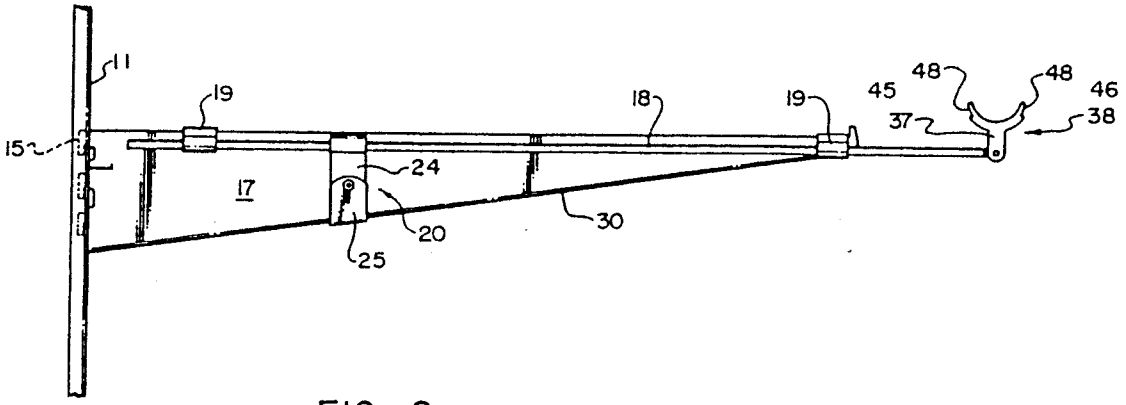
FIG. 2, is a side elevation view of the support structure for a lamp housing.

Referring now to the drawings:

In the illustrated preferred embodiment, the cantilevered lighting system of the invention is shown generally at 10.

As shown, standard shelf support posts 11 and 12 are adapted to be attached to a room wall, interior surface of a display case or another flat surface, by screws 13. The shelf support posts 11 each have slots 14, spaced apart, and extending longitudinally along the lengths of which posts.

The shelf support posts 11 and 12 are each adapted to receive tongues 15 and 16, each having a right angle hook end, of conventional narrow shelf support brackets 17. The brackets are accordingly cantilevered from the posts, such that a bracket 17 top edge 22, is at a right angle to each shelf support post, as shown, utilizing standard commercial hardware.

Figure 1:
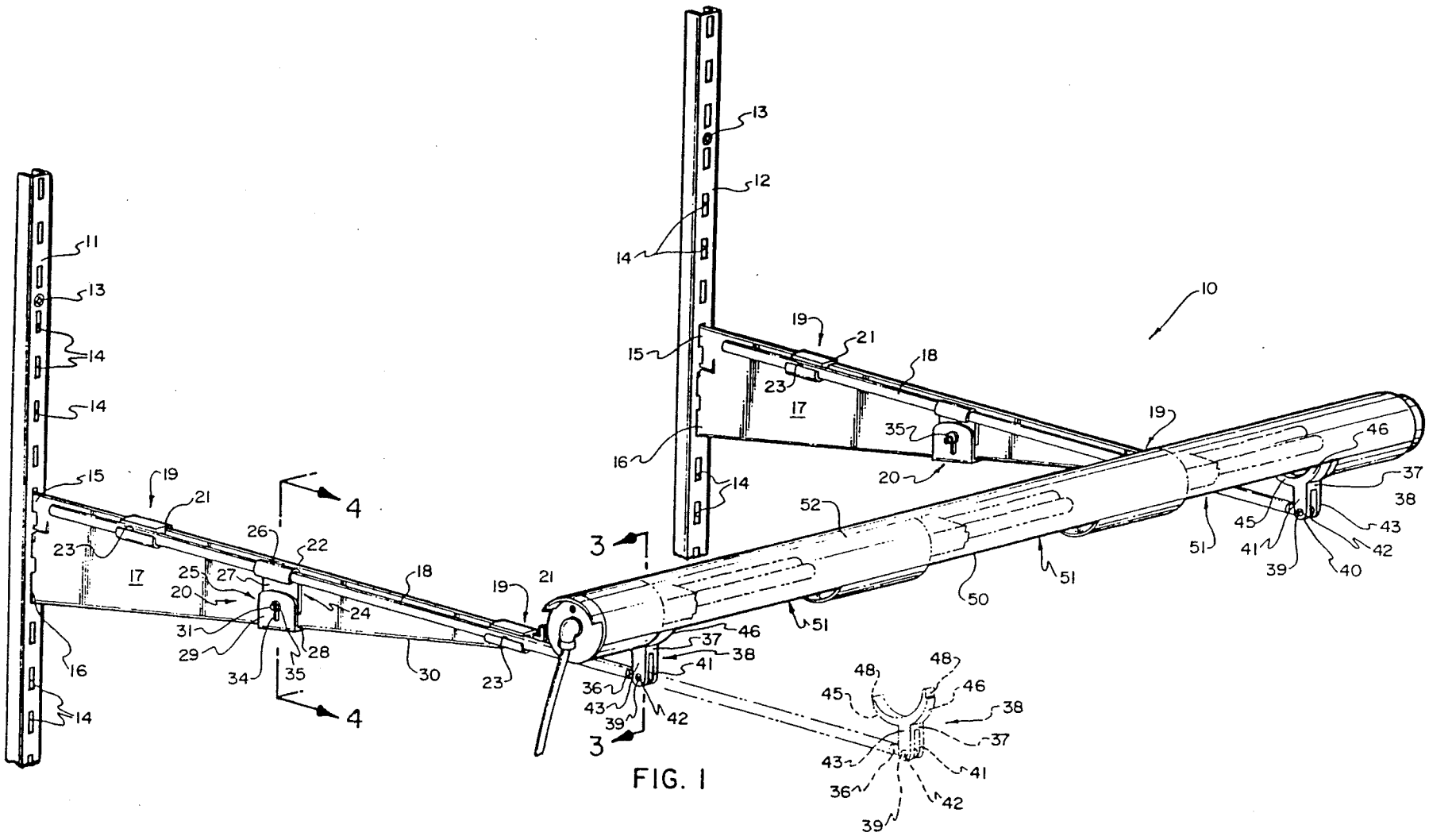
FIG. 1 is a perspective view of the cantilevered lighting system of the invention, with an alternate position of a support rod and "PL" type fluorescent light tubes shown in phantom.

As shown in FIGS. 1 and 2, support rods 18 are each secured to the support brackets 17 by a pair of upper clips 19 and a lower, adjustable wedge clip 20.

The upper clips 19 each include, a hook 21 that is to extend and grip over a top edge 22 of a bracket 17, and passage 23 through which the rod 18 is snugly telescoped.

Each lower wedge clip 20 is made up of separate upper piece 24 and lower piece 25. Shown in FIG. 4, the upper piece 24 includes a partial bore or barrel 26 edge through which the rod 18 is snugly telescoped and a tang 27 extending at approximately a right angle therefrom. The lower piece 25 includes a hook 28 that is angularly bent from a tang 29 such that the bend is angled to provide a rest for and contain the lower edge 30 of the bracket 17. The tanges 27 and 29 are to lie over one another. A bolt 31 is passed through a hole 33 and a slot 34 of the tangs 27 and 29, respectively, and a nut 35 is threaded onto the bolt, to adjustably secure the tangs of the upper and lower pieces 24 and 25 together.

Figure 3:
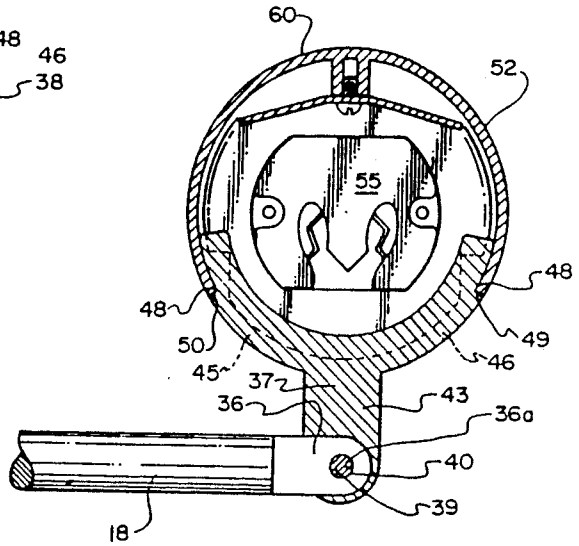
FIG. 3, is an enlarged vertical section taken on line 3—3 of FIG. 1, but showing a lamp socket for a Bi Pin fluorescent tube as an alternate form of light tube.

Shown in FIGS. 1, 2 and 3, one end of each support rod 18 is flattened on both sides at 36 and has a hole **36*a* formed therethrough. A bifurcated leg 37 of a support cradle 38 straddles the support rod flattened end 36 and is secured thereto by a bolt 39 that is inserted through an unthreaded hole 40 in one limb 41 of the bifurcated leg 37, through the support rod flattened end, hole 36*a* and is threaded into a hole 42 in the other limb 43** of that bifurcated leg.

As shown in FIGS. 1, 2 and 3, the support cradle 38 is of generally "Y" shape, with unitary arms 45 and 46 that extend and curve upwardly from leg 37. The top of each arm 45 and 46 is notched at 48 so that the tips will engage and hold the edges 49 and 50, respectively, of a light emitting opening 51 of a tubular light housing 52. The edges 49 and 50 of the opening 51 of housing 52 are to pull apart and spring together into the notches 48 so that the housing is securely held by the support cradle 38.

The tubular light housing is the same as that disclosed in my co-pending application for U.S. patent, Ser. No. 511,401, filed April 19, 1990, set out above. As is more particularly disclosed in the aforementioned co-pending application, the light housing 52 may be of any desired length and may include one or more light tubes as the source of light for the system. As shown in FIG. 1, three "PL" type fluorescent light tubes 53 may be provided in the housing 52, or alternatively, a fluorescent tube 63, as shown in FIG. 5, having the usual connector pins may be inserted into a socket 55 provided therefor in the housing.

Figure 4:
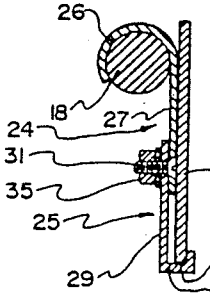
FIG. 4, is a vertical section taken on the line 4—4 of FIG. 1.
Figure 5:
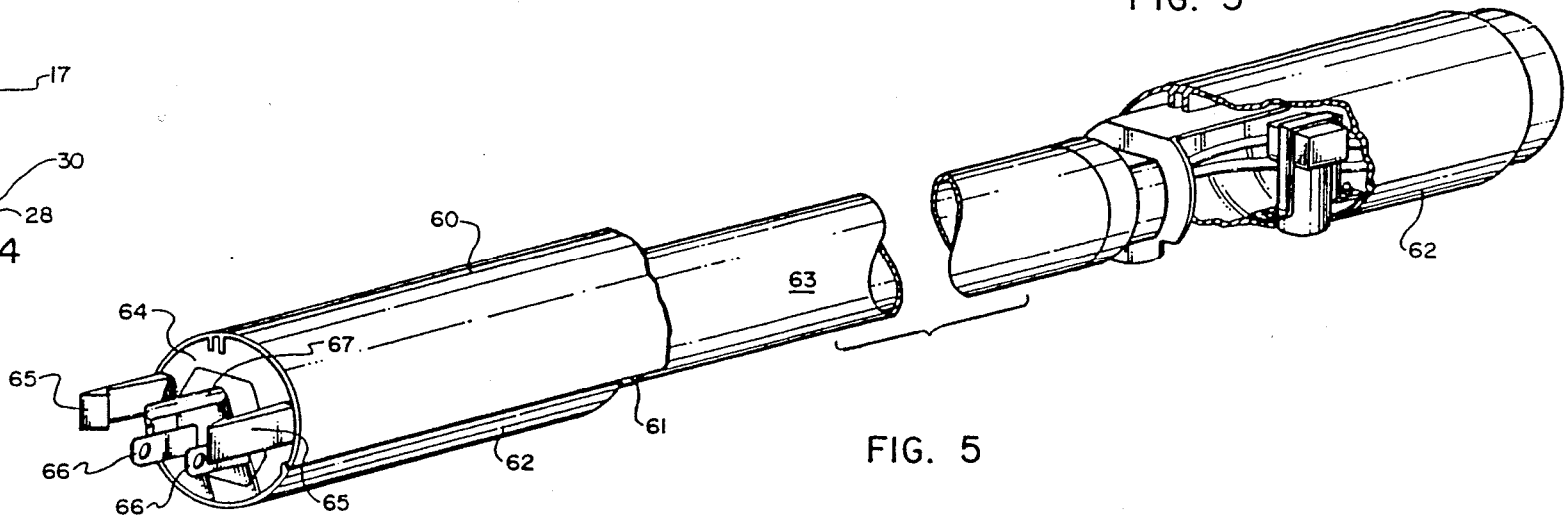
FIG. 5, is a perspective view of a lamp housing showing a Bi Pin fluorescent tube and starter that includes a ballast, the lamp housing arranged to be coupled to another such housing.

A coupled light housing may be provided using a plurality of light housings 60 for fluorescent tubes, as shown in FIGS. 4 and 5. The housing 60 is tubular, with a light emitting opening 61 formed in the wall thereof and housing covers 62 snapped into the opening to close the portion of the opening not adjacent to a light tube 63. This housing construction is the preferably same as disclosed in my aforesaid co-pending application Ser. No. 511,401.

Shown in FIG. 5, the light housing 60 includes a connector plate 64 at one end thereof, with spaced apart clips 65, male plugs 66 and a ground connector post 67 projecting therefrom. The other end of the housing 60 includes receptacles to receive the clips, plugs and post of a similarly constructed housing. The plugs and post and corresponding receptacles in the other end of housing 60 are wired in conventional fashion using wires passed through the housing. With the housing 60, an interconnected housing can be supported, as necessary, depending on span length by the necessary support posts, shelf support brackets, support rods and clips as previously described.

The light system 10 is readily installed wherever the support posts and brackets 17 may be positioned and may be of any desired length. The wedge clips 20 are adjustable and will secure the rods 18 through a wedging action with the top and angled bottom edges of brackets 17, whether the rods are pulled out or pushed in relative to the brackets. Thus, the position of the light tube can be readily varied with respect to its distance from the wall or surface on which the posts 11 and 12 are mounted.

The direction of the emitted light is also readily changed by loosening bolts 39, turning the cradles 38 about the bolts to direct the light as desired, and then retightening the bolts 39 to fix the positions of the cradles and light tubes.

Although a preferred form of my invention has been herein disclosed, it is to be understood that the present disclosure is by way of example and that variations are possible without departing from the subject matter coming within the scope of the following claims and a reasonable equivalency thereof, which subject matter I regard as my invention.

I claim:

1. A cantilevered lighting system comprising: at least a pair of spaced apart support posts; a support bracket extending from each said support post, said support bracket having a top edge and a bottom edge angled with respect to said top edge; a support rod for each said support bracket; means for adjustably securing each said support rod to a support bracket, said means including at least a pair of spaced apart top clips, each having a hook for extending over the top edge of said support bracket and a passage through which said support rod is inserted and a lower bracket having a bore through which said support rod is inserted and a hook angled with respect to the bore to contain the bottom edge of said support bracket; an elongate light housing having at least one lamp therein; and means fixed to an end of each said support rod to attach to the light housing.

2. A lighting system as in claim 1, wherein the means fixed to an end of each support rod to attach to the light housing is adjustably fixed to rotate about a pivot axis.

3. A lighting system as in claim 2, wherein the elongate housing is of tubular configuration, with an elongate opening in a sidewall thereof.

4. A lighting system as in claim 3, wherein the means fixed to an end of each support rod to attach to the light housing comprises a cradle with a pair of oppositely upstanding arms, each arm having a notch in the end thereof to receive an edge of the elongate opening in said light housing, a bifurcated leg straddling the end of the support rod and bolt means to releasably lock said bifurcated leg to the end of said support rod.

* * * * *